US009957909B2

(12) United States Patent
Denk

(10) Patent No.: US 9,957,909 B2
(45) Date of Patent: May 1, 2018

(54) DEVICE AND METHOD FOR CONTROLLING AN INJECTION VALVE

(71) Applicant: Continental Automotive GmbH, Hannover (DE)

(72) Inventor: Frank Denk, Obertraubling (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 24 days.

(21) Appl. No.: 15/309,853

(22) PCT Filed: Mar. 25, 2015

(86) PCT No.: PCT/EP2015/056402
§ 371 (c)(1),
(2) Date: Nov. 9, 2016

(87) PCT Pub. No.: WO2015/169501
PCT Pub. Date: Nov. 12, 2015

(65) Prior Publication Data

US 2017/0145942 A1 May 25, 2017

(30) Foreign Application Priority Data

May 9, 2014 (DE) ..... 10 2014 208 753

(51) Int. Cl.
*F02D 41/20* (2006.01)
*F02D 41/24* (2006.01)

(52) U.S. Cl.
CPC ..... *F02D 41/2467* (2013.01); *F02D 41/20* (2013.01); *F02D 41/248* (2013.01); (Continued)

(58) Field of Classification Search
CPC ..... F02D 41/20; F02D 41/24; F02D 41/248; F02D 41/2467; F02D 41/2013; F02D 41/2055; F02D 41/2058
See application file for complete search history.

(56) References Cited

U.S. PATENT DOCUMENTS 6,129,073 A * 10/2000 Yamakado ..... F02D 41/20 123/490
6,615,805 B2 * 9/2003 Yamakado ..... F02D 41/20 123/490

(Continued)

FOREIGN PATENT DOCUMENTS

DE 10150199 A1 4/2003 ..... H01F 7/18
DE 102004020937 A1 11/2005 ..... F02D 41/20

(Continued)

OTHER PUBLICATIONS

Korean Notice of Allowance, Application No. 2017083846856, 3 pages, dated Nov. 30, 2017.
German Office Action, Application No. 102014208753.8, 5 pages, dated Nov. 26, 2014.
International Search Report and Written Opinion, Application No. PCT/EP2015/056402, 17 pages, dated Jun. 1, 2015.

*Primary Examiner* — Hieu T Vo
(74) *Attorney, Agent, or Firm* — Slayden Grubert Beard PLLC

(57) ABSTRACT

The present disclosure relates to injection valves. The teachings thereof may be embodied in various valves, fuel injectors, and methods for controlling valves. An example method for setting operational parameters of a fuel injector may include: determining a measurement-specific maximum current value; applying a voltage pulse to the coil drive of the fuel injector; detecting a time curve of the current intensity of a current flowing through the coil drive; ending the voltage pulse when the detected current intensity reaches the maximum current value; and storing the time curve of the detected current intensity. The method may include generating a plurality of differential curves each based on two stored time curves of the detected current intensity for successive measurements; determining a peak current for driving the actuator of the fuel injector based at least in part on the plurality of differential curves; and operating the coil at the determined peak current.

8 Claims, 1 Drawing Sheet

(52) U.S. Cl.
CPC ..... *F02D 2041/2013* (2013.01); *F02D 2041/2055* (2013.01); *F02D 2041/2058* (2013.01)

(56) References Cited

U.S. PATENT DOCUMENTS

| | | | | |
|---|---|---|---|---|
| 6,949,923 | B2 | 9/2005 | Schultz et al. | 324/207.18 |
| 7,413,160 | B2 | 8/2008 | Beilharz et al. | 251/30.01 |
| 9,127,634 | B2 | 9/2015 | Brandt et al. | |
| 2006/0082252 | A1 | 4/2006 | Allmendinger et al. | 310/316.03 |
| 2015/0184626 | A1* | 7/2015 | Denk | F02D 41/2096 123/478 |
| 2015/0226148 | A1 | 8/2015 | Beer et al. | 123/480 |
| 2016/0102628 | A1 | 4/2016 | Denk | 701/105 |
| 2017/0175666 | A1* | 6/2017 | Kim | F02D 41/1402 |

FOREIGN PATENT DOCUMENTS

| | | | | | |
|---|---|---|---|---|---|
| DE | 102004023545 | A1 | | 12/2005 | F02D 41/20 |
| DE | 10356858 | B4 | | 4/2007 | F02D 41/20 |
| DE | 102010042467 | A1 | | 4/2012 | F02D 41/20 |
| DE | 102012213883 | A1 | | 2/2014 | F02D 41/20 |
| DE | 102013207842 | A1 | | 10/2014 | F02D 41/20 |
| JP | 2002004922 | A | * | 1/2002 | F02D 41/04 |
| KR | 20110066475 | A | | 6/2011 | F02D 41/04 |
| WO | 2014/044837 | A1 | | 3/2014 | F02D 41/24 |
| WO | 2015/169501 | | | 11/2015 | F02D 41/24 |

* cited by examiner

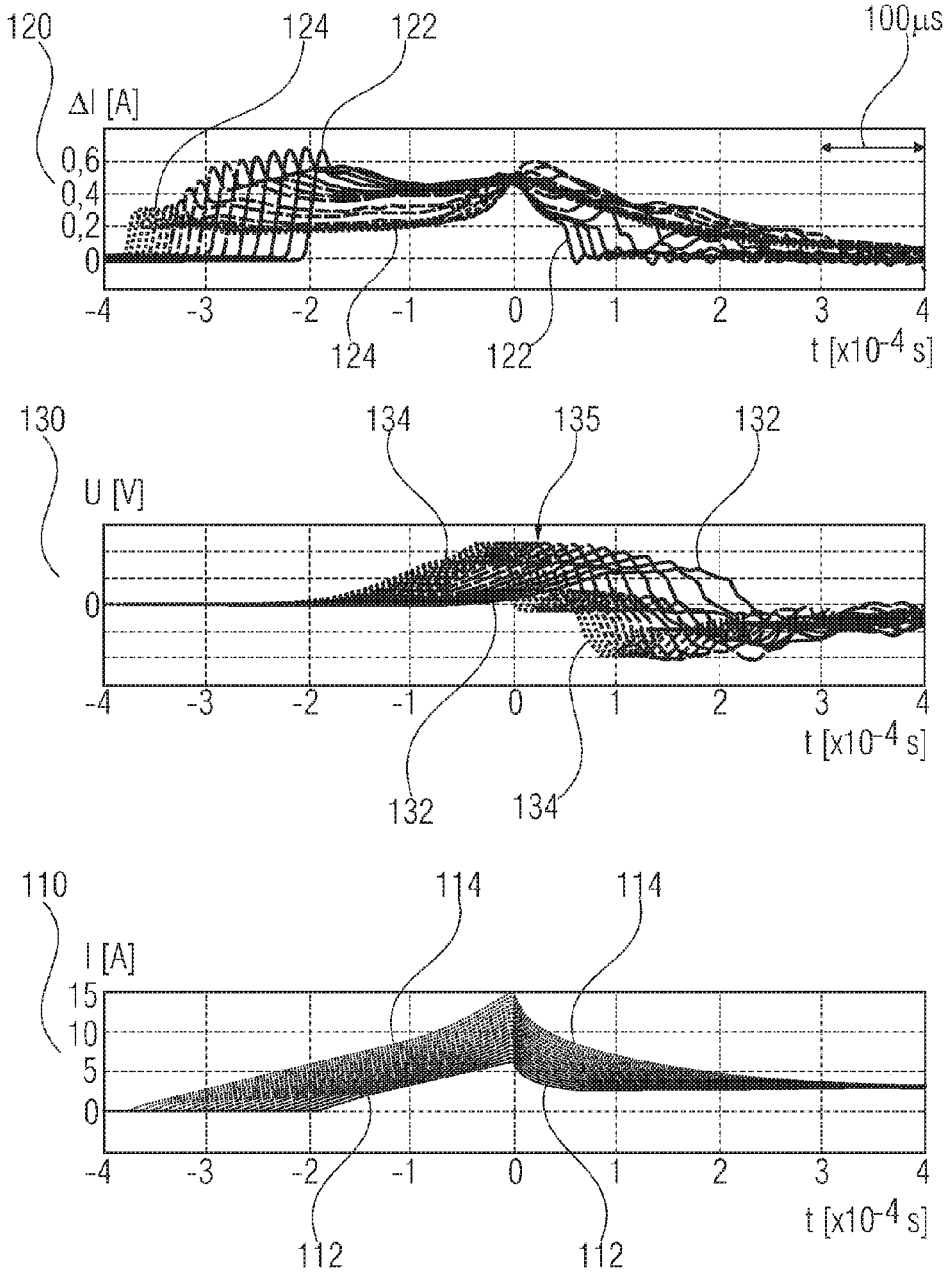
120
124
122
100µs
ΔI [A]
0,6
0,4
0,2
0
-4
-3
-2
-1
0
1
2
3
4
124
122
t [x10-4 s]
130
134
135
132
U [V]
0
-4
-3
-2
-1
0
1
2
3
4
t [x10-4 s]
132
134
110
114
114
I [A]
15
10
5
0
-4
-3
-2
-1
0
1
2
3
4
t [x10-4 s]
112
112

DEVICE AND METHOD FOR CONTROLLING AN INJECTION VALVE

CROSS-REFERENCE TO RELATED APPLICATIONS

This application is a U.S. National Stage Application of International Application No. PCT/EP2015/056402 filed Mar. 25, 2015, which designates the United States of America, and claims priority to DE Application No. 10 2014 208 753.8 filed May 9, 2014, the contents of which are hereby incorporated by reference in their entirety.

TECHNICAL FIELD

The present disclosure relates to injection valves. The teachings thereof may be embodied in various valves, fuel injectors, and methods for controlling valves.

BACKGROUND

During operation of fuel injectors with coil drive, because of electrical, magnetic, mechanical, and hydraulic tolerances, different chronological opening and closing responses of the individual injectors and thus variations in the respective injection volume occur. The relative injection volume differences from injector to injector increase as the injection times become shorter and shorter. When injection volumes are large, these relative volume differences are small and without practical significance. The development in the direction of smaller injection volumes and times, however, renders it no longer possible to disregard the influence of the relative volume differences. Therefore, it is of great importance to know the characteristic properties of a given fuel injector individually and precisely, so that these can be considered when driving the fuel injector.

SUMMARY

The teachings of the present disclosure may be embodied in a method for ascertaining parameter values for a fuel injector for an internal combustion engine of a motor vehicle, said fuel injector having a coil drive for moving a closing element. Some embodiments may include a corresponding device, a motor controller, and a computer program. The teachings may enable ascertaining relevant parameter values for a fuel injector, so that the latter can be driven precisely.

Some embodiments may include a method for ascertaining parameter values for a fuel injector for an internal combustion engine of a motor vehicle, said fuel injector having a coil drive for moving the closing element. The method may include carrying out a plurality of measurements. Each measurement may include: determining a measurement-specific maximum current value, applying a voltage pulse to the coil drive of the fuel injector, detecting a time curve of the current intensity (112, 114) of a current flowing through the coil drive, ending the voltage pulse when the detected current intensity reaches the maximum current value, and storing the time curve of the detected current intensity. The method may further include: determining a plurality of differential curves (122, 124), wherein each differential curve is based on the stored time curves of the detected current intensity for two successive measurements, and determining a parameter value for the fuel injector on the basis of the plurality of differential curves.

In some embodiments, each measurement of the plurality of measurements further has detection of a time curve of the movement (132, 134) of the closing element, and storage of the time curve of the detected movement, and the determination of the parameter value for the fuel injector is further based on the time curves of the movement.

In some embodiments, the determination of the parameter value for the fuel injector has a determination of a saturation current value, at which the fuel injector is in saturation.

In some embodiments, the determination of a measurement-specific maximum current value is carried out in such a way that the measurement-specific maximum current value for a following measurement is increased by a predetermined value as compared with the measurement-specific maximum current value of the immediately preceding measurement.

Some embodiments may include generation of a graphic representation of the time curves of the detected current intensities, the time curves of the detected movements and the plurality of differential curves, wherein the graphic representation is configured such that the time in each measurement at which the voltage pulse was ended constitutes a reference point. Some embodiments may include a device for ascertaining parameter values for a fuel injector for an internal combustion engine of a motor vehicle, said fuel injector having a coil drive for moving a closing element. The device may include: an application unit for applying a voltage pulse to the coil drive of the fuel injector, a detection unit for detecting a time curve of the current intensity of a current flowing through the coil drive and/or a time curve of the movement of the closing element, a storage unit for storing the detected time curves, and a determination unit for determining a plurality of differential curves based on stored time curves of the detected current intensities, and a control unit which is configured to carry out the method as claimed in one of the preceding claims.

Some embodiments may include a motor controller for an internal combustion engine of a motor vehicle configured to carry out one or more of the methods as described above.

Some embodiments may include a computer program for ascertaining parameter values for a fuel injector for an internal combustion engine of a motor vehicle, said fuel injector having a coil drive for moving a closing element, configured to carry out one or more of the methods as describe above.

BRIEF DESCRIPTION OF THE DRAWINGS

FIG. 1 shows a graphic representation, generated in accordance with the teachings of the present disclosure, of appropriate current curves, movement curves, and current differential curves for a fuel injector as a function of time in conjunction with an exemplary embodiment.

DETAILED DESCRIPTION

Some embodiments may include a method for ascertaining parameter values for a fuel injector for an internal combustion engine of a motor vehicle is described, said fuel injector having a coil drive for moving a closing element. The method may include: (a) carrying out a plurality of measurements, wherein for each measurement (a1) a measurement specific maximum current value is determined, (a2) a voltage pulse is applied to the coil drive of the fuel injector, (a3) a time curve of the current intensity of a current flowing through the coil drive is detected, (a4) the voltage pulses are terminated when the detected current intensity of the maximum current value is attained, and (a5) the time curve of the detected current intensity is stored, (b) determining a plurality of differential curves, each differential curve being based on the stored time curves of the detected current intensities for two successive measurements, and (c) determining a parameter value for the fuel injector on the basis of the plurality of differential curves.

The time curve of the current intensity during an opening operation of a fuel injector (in which the coil drive has a voltage pulse (boost voltage) applied thereto) depends on the inductance of the coil drive. In addition to the changing inherent inductance of the coil drive (because of the non-linear ferromagnetic magnetic material), there is a movement inductance component resulting from the armature movement. The movement inductance component begins with the beginning of the opening phase (armature/needle movement begins) and ends at the end of the opening phase (armature/needle movement ends). If, then, this injector is operated with different current profiles which behave in a time similar manner in their currents, in the event of variations in the level of the magnitude of the current, the inductive influence and the change thereof will change characteristically. With the method described, different items of information, e.g., parameter values, which can be used for characterization of the present fuel injector, can be determined both automatically and also manually by means of inspection.

In this document, "voltage pulse" designates in particular a so-called boost voltage pulse, which is suitable to open the fuel injector within a short time.

In this document, "closing element" designates a movable element of the fuel injector which can be moved by the coil drive in order to open and to close the fuel injector.

In some embodiments, following the application of the respective voltage pulse, the injector may be kept open for a time period during an injection phase. The detection of the time curve of the current intensity may be carried out both during the application of the respective voltage pulse (e.g., during the boost phase) and thereafter (e.g., during the injection phase and/or closing phase).

It is characteristic of each measurement that the voltage pulse is switched off at the time at which the current intensity reaches a defined measurement-specific maximum current value (peak current). In other words, a unique maximum current value may be used for each measurement. Switching off the voltage pulse leads to the fuel injector changing to a freewheeling phase, in that a lower voltage (for example ground, vehicle electrical voltage or another defined voltage) is imposed on the coil drive.

By determining a plurality of differential curves, wherein each differential curve is based on the stored time curves of the detected current intensities for two successive measurements, it is possible to detect whether the corresponding difference in the maximum current value (peak current) has a greater or rather lesser influence on the time curve of the current intensity. In other words, it is possible to detect the extent to which a change in the peak current value when driving the fuel injector will have a substantial effect on the time curve of the current intensity (in all or in part of the time interval).

By means of evaluating and analyzing the differential curves, it is possible to determine various items of information which can be used for characterization of the fuel injector. More specifically, information in relation to eddy current characteristics, in relation to the magnetization behavior as far as saturation and to the behavior beyond that as far as over excitation can be detected. The information and/or parameter values determined in this way then permit/s precise adaptation of the drive parameters, so that the fuel injector operates as desired.

In some embodiments, each measurement of the plurality of measurements further has (a) detection of a time curve of the movement of the closing element and (b) storage of the time curve of the detected movement, wherein the determination of the parameter value for the fuel injector is also based on the time curves of the detected movement. The movement of the closing element can be detected, for example, by means of an acceleration sensor. By means of analysis of the time curves of the movement of the closing element for the various maximum current values (or peak current values), it is possible, for example, to detect whether a characteristic state of the fuel injector (for example end of the opening phase) is reached before or after the ending of the voltage pulse. Thus, for example, an optimal peak current value for driving the fuel injector can be defined.

In some embodiments, the determination of the parameter value for the fuel injector has a determination of a saturation current value, at which the fuel injector is in saturation.

In this document "saturation" designates a state in which a further increase in the coil current does not concomitantly lead to a corresponding further movement of the movement element of the fuel injector.

The saturation current value can be found by analyzing the differential curves, e.g., by comparing the differential curves. If two or more successive differential curves run very similarly, this is an indication that the fuel injector is in saturation at the corresponding peak current values.

In some embodiments, the definition of a measurement-specific maximum current value is carried out in such a way that the measurement-specific maximum current value for a following measurement is increased by a predetermined value as compared with the measurement-specific maximum current value of the immediately preceding measurement. In other words, the measurement-specific maximum current value is increased step-by-step for each measurement.

The predetermined value with which the measurement-specific maximum current is increased step-by-step is, for example, 0.1 A to 1 A, such as for example 0.25 A to 0.75 A, such as for example about 0.5 A. The measurement-specific maximum current value for the first measurement may be, for example, 5 A and, for the last measurement, for example 15 A.

In some embodiments, the method further has generation of a graphic representation of the time curves of the detected current intensities, the time curves of the detected movements and the plurality of differential curves, wherein the graphic representation is configured such that the time in each measurement at which the voltage pulse was ended constitutes a reference point. Expressed in another way, the time curves of the current intensities and movements and the differential curves are represented as functions of time such that the values which correspond to the time at which the voltage pulse in the respective measurements was ended are represented above one another (i.e. for a specific value (for example t=0) on the time axis). The individual curves can, for example, be identified in color, so that the assignment of the various curves to the various values of the peak current is made easier.

This representation permits a person skilled in the art to descry much information in relation to the properties of the fuel injector. In addition to the aforementioned saturation of the fuel injector, the person skilled in the art can, amongst other things, detect the eddy current characteristics and the behavior of the fuel injector when overexcited. Furthermore, the person skilled in the art can make statements about the magnetic material used with regard to conductivity and hysteresis curve, and detect characteristic points of the armature positions. Therefore, adaptation with regard to the optimum current profile and the hydraulic behavior is possible. The event times (start/end of the opening/closing operation) can be placed as a function of pressure in current ranges that are needed/usable for the detection.

This adaptation thus also defines a hardware-optimized and cost-optimized current controller. As a result of knowledge of the event times, the injection volume can be set more accurately by adapting the energization period.

If, for example, it is established that the start of the opening operation is time-shifted, the starting time of the voltage pulse which is applied to the coil drive can be shifted appropriately. If, for example, it is established that the end of the opening operation is time-shifted, the injection period can be adapted in order to ensure that the envisaged fuel quantity is injected. In other words, the time period of the voltage pulse in the event of delayed opening of the fuel injector can be lengthened in order to avoid too little fuel being injected. In a similar way, the time period of the voltage pulse in the case of premature opening of the fuel injector can be shortened, in order to avoid too much fuel being injected.

The aforementioned corrections can advantageously be carried out in a pulse-individual manner, which means for each individual opening operation. The corrections and time shifts can also take into account physical system parameters, such as fuel temperature, distance from the previous injection operation and so on. This can be done, for example, by using appropriate pilot control characteristic curves or maps or a model.

Some embodiments may include a device for ascertaining parameter values for a fuel injector for an internal combustion engine of a motor vehicle, said fuel injector having a coil drive for moving a closing element. The device described has the following: (a) an application unit for applying a voltage pulse to the coil drive of the fuel injector, (b) a detection unit for detecting a time curve of the current intensity of a current flowing through the coil drive and/or a time curve of the movement of the closing element, (c) a storage unit for storing the detected time profiles, (d) a determination unit for determining a plurality of differential curves based on stored time curves of the detected current intensities, and (e) a control unit which is configured to carry out the method according to the first aspect or one of the above-described embodiments.

The device described is based substantially on the same idea as has been described above in conjunction with the methods. The device described thus constitutes a hardware implementation of the method. The application unit and detection unit can thus be implemented with conventional voltage generators and current measuring devices known from the field of motor control. In a similar way, the storage unit, determination unit and control unit can be implemented with conventional storage and processing units (microprocessor) of a motor controller. The device makes possible a simple, precise and economical acquisition of characteristic parameter values for a fuel injector, in particular the determination of a suitable current profile for driving the fuel injector.

Some embodiments may include a motor controller for a vehicle. The motor controller described is configured to carry out the methods described above. This motor controller permits characteristic parameters of the individual fuel injectors to be acquired and taken into account with simple and economical means.

Some embodiments may include a computer program for acquiring parameter values for a fuel injector for an internal combustion engine of a motor vehicle, said fuel injector having a coil drive for moving a closing element. The computer program described is configured to carry out the methods described above when it is executed by a processor or μ-controller.

In the sense of this document, the naming of such a computer program is equivalent to the concept of a program element, a computer program product and/or a computer-readable medium which contains instructions for controlling a computer system to coordinate the operation of a system or a method in a suitable way in order to achieve the effects linked with the methods described herein. The computer program can be implemented as computer-readable instruction code in any suitable programming language such as, for example, in Assembler, Java, C++, etc. The computer program can be stored on a computer-readable storage medium (CD-ROM, DVD, Blu-ray disk, removable drive, volatile or nonvolatile memory, incorporated memory/processor, etc.). The instruction code can program a computer or other programmable devices such as in particular a control device for a motor of a motor vehicle in such a way that the desired functions are executed. Furthermore, the computer program can be provided in a network, such as the Internet, for example, from which it can be downloaded as required by a user.

The invention can be implemented both by means of a computer program, i.e. software, and by means of one or more specific electric circuits, i.e. in hardware, or in any desired hybrid form, i.e. by means of software components and hardware components.

It is pointed out that embodiments of the invention have been described with reference to different subjects of the invention. In particular, some embodiments of the invention are described with method claims and other embodiments of the invention with device claims. However, it will immediately become clear to the person skilled in the art, when reading this application, that, if not explicitly otherwise specified, in addition to a combination of features which belong to one type of subject of the invention, any desired combination of features which belong to different types of subject of the invention is also possible.

FIG. 1 shows a series 110 of current curves, a series 120 of current differential curves, and a series 130 of movement curves for a fuel injector as functions of time according to an exemplary embodiment.

Each curve in the series 110 of current curves shows the current curve when a voltage pulse of 65 V (boost voltage) is applied to a fuel injector until a specific (measurement-specific) current intensity (maximum current value) between about 6 A and about 15 A is reached. In other words, each curve in the series 110 of current curves corresponds to precisely one of a plurality of measurements. The reference point used for the curves is the time at which the measurement-specific maximum current value is reached. This time is shown as t=0. Thus, the lower curve 112 shows the current curve for a first measurement, in which the measurement-specific maximum current value is about 6 A. The curve precisely above the lower curve 112 shows the current curve for a second measurement, at which the measurement-specific maximum current value is higher by 0.5 A, and so on. The upper curve 114 shows the current curve from the last measurement, at which the measurement-specific maximum current value is about 15 A.

Each curve in the series 120 of current differential curves shows a calculated difference between two adjacent current curves in the series 110 of current curves. In other words, each curve in the series 120 shows the difference between the detected current curves in two successive measurements, wherein the current curves (as mentioned above) are synchronized with starting point at the time at which the respective measurement-specific maximum current value was reached. The curve 122 shows, for example, the difference between the two lowest curves in the series 110 of current curves, i.e., between the second curve from bottom and the bottom curve 112. In a similar way, the curve 124 shows the difference between the two uppermost curves in the series 110 of current curves, i.e., between the upper curve 114 and the curve running just below the latter.

Each curve in the series 130 of movement curves shows the time curve of the starting voltage of an acceleration sensor in conjunction with one of the measurements. The acceleration sensor is fitted in the fuel injector to detect the movement of a relevant part, such as a coil module or an injector needle, for example. Each curve in the series 130 thus corresponds to a coil current curve from the series 110. The movement curve 132 thus corresponds to the first measurement, i.e., the coil current curve 112, and the movement curve 134 corresponds to the last measurement, i.e., the coil current curve 114.

The series 110, 120, 130 of curves shown in FIG. 1 can be evaluated both in an automated manner and/or manually.

In particular, an automated evaluation by means of a processor can be used to ascertain a suitable peak current (maximum current value) for driving the fuel injector. This can be done, firstly, by analyzing the series of curves 120 and secondly by analyzing the series of curves 130. For instance, a comparison of adjacent differential curves in the series of curves 120 provides information as to whether the fuel injector is being operated in saturation. If the differential curves run relatively constantly and superimposing on one another, it can be assumed that the fuel injector is in saturation. Since this is associated with a waste both of time and of energy, a peak current at which this is not the case should be selected. Furthermore, it can be determined, for example, whether the opening of the fuel injector takes place expediently relative to the current profile. As indicated by arrow 135, the movement curve 134 has a maximum value before t=0, which is a further indication that the current curve 114 drives the fuel injector in saturation. The processor looks for that curve from the series of curves 130 which has its maximum value as close as possible to t=0, in order to identify a suitable peak current for the operation of the fuel injector. The precision can possibly be increased further by interpolation.

A manual evaluation by user can be carried out by studying the three series of curves 110, 120, 130 on a monitor. The graphic representation can advantageously be carried out in color, for example by curves in the three series of curves 110, 120, 130 which correspond to specific maximum current values also having the same color. This representation permits a user having specialist knowledge to descry a lot of information in relation to the properties of the fuel injector. In addition to the saturation of the fuel injector described above, the user can amongst other things detect the eddy current characteristics and the response of the fuel injector when overexcited. Furthermore, the user can make statements about the magnetic material used with regard to conductivity and hysteresis curve, and detect characteristic points of the armature positions. Thus, adaptation with regard to the optimal current profile and the hydraulic behavior is possible. The event times (start/end of the opening/closing operation) can be placed as a function of pressure in current ranges needed/usable for the detection. This adaptation thus also defines a hardware-optimized and cost-optimized current controller. Finally, with knowledge of the event times, the injection volume can be set more accurately by adapting the energization period.

LIST OF DESIGNATIONS

110 Current curves
112 Current curve
114 Current curve
120 Current differential curves
122 Current differential curve
124 Current differential curve
130 Movement curves
132 Movement curve
134 Movement curve
135 Arrow

The invention claimed is:

1. A method for setting operational parameters of a fuel injector for an internal combustion engine of a motor vehicle, the fuel injector having a coil drive for moving a closing element, the method comprising:

carrying out a plurality of measurements, wherein each measurement comprises:

determining a measurement-specific maximum current value;

applying a voltage pulse to the coil drive of the fuel injector;

detecting a time curve of the current intensity of a current flowing through the coil drive;

ending the voltage pulse when the detected current intensity reaches the maximum current value; and storing the time curve of the detected current intensity;

generating a plurality of differential curves each based on two stored time curves of the detected current intensity for successive measurements; and determining a peak current for driving the actuator of the fuel injector based at least in part on the plurality of differential curves; and operating the coil at the determined peak current.

2. The method as claimed in claim 1, wherein each measurement of the plurality of measurements further comprises:

detecting a time curve of the movement of the closing element; and storing the time curve of the detected movement; and wherein determining the peak current for the fuel injector depends at least in part on the time curves of the detected movement.

3. The method as claimed in claim 1, wherein determining the peak current for the fuel injector includes determining a saturation current value at which the fuel injector is in saturation.

4. The method as claimed in claim 1, wherein determining a measurement-specific maximum current value includes increasing the measurement-specific maximum current value for a following measurement by a predetermined value as compared with the measurement-specific maximum current value of the immediately preceding measurement.

5. The method as claimed in claim 1, further comprising generating a graphic representation of the time curves of the detected current intensities, the time curves of the detected movements, and the plurality of differential curves, and wherein the graphic representation includes a reference point for the time in each measurement at which the voltage pulse was ended.

6. A device for ascertaining parameter values for a fuel injector for an internal combustion engine of a motor vehicle, said fuel injector having a coil drive for moving a closing element, the device comprising:

an application unit for applying a voltage pulse to the coil drive of the fuel injector;

a detection unit for detecting a time curve of the current intensity of a current flowing through the coil drive or a time curve of the movement of the closing element;

a memory for storing the detected time curves; and a processor for:

determining a plurality of differential curves based on stored time curves of the detected current intensities;

generating a plurality of differential curves each based on two stored time curves of the detected current intensity for successive measurements; and determining a peak current for driving the actuator of the fuel injector based at least in part on the plurality of differential curves.

7. A motor controller for an internal combustion engine of a motor vehicle, the internal combustion engine comprising at least one fuel injector having a coil drive for moving a closing element, the device comprising:

an application unit for applying a voltage pulse to the coil drive of the fuel injector;

a detection unit for detecting a time curve of the current intensity of a current flowing through the coil drive or a time curve of the movement of the closing element;

a memory for storing the detected time curves; and a processor for:

determining a plurality of differential curves based on stored time curves of the detected current intensities;

generating a plurality of differential curves each based on two stored time curves of the detected current intensity for successive measurements; and determining a peak current for driving the actuator of the fuel injector based at least in part on the plurality of differential curves;

wherein the application unit operates the coil at the determined peak current.

8. A computer program for ascertaining parameter values for a fuel injector for an internal combustion engine of a motor vehicle, the fuel injector having a coil drive for moving a closing element, wherein the computer program, when it is executed by a processor, is configured to carry out a method comprising:

carrying out a plurality of measurements, wherein each measurement comprises:

determining a measurement-specific maximum current value;

applying a voltage pulse to the coil drive of the fuel injector;

detecting a time curve of the current intensity of a current flowing through the coil drive;

ending the voltage pulse when the detected current intensity reaches the maximum current value; and storing the time curve of the detected current intensity;

generating a plurality of differential curves each based on two stored time curves of the detected current intensity for successive measurements;

determining a peak current for driving the actuator of the fuel injector based at least in part on the plurality of differential curves; and operating the coil at the determined peak current.

* * * * *